US008477568B2

(12) United States Patent
Go

(10) Patent No.: US 8,477,568 B2
(45) Date of Patent: Jul. 2, 2013

(54) ALARM CLOCK WHICH OPERATES IN CONJUNCTION WITH A GRADUALLY FADING-IN LAMP

(76) Inventor: Jae-Chun Go, Bucheon-si (KR)

( * ) Notice: Subject to any disclaimer, the term of this patent is extended or adjusted under 35 U.S.C. 154(b) by 68 days.

(21) Appl. No.: 13/255,216

(22) PCT Filed: Mar. 8, 2010

(86) PCT No.: PCT/KR2010/001418

§ 371 (c)(1),
(2), (4) Date: Sep. 7, 2011

(87) PCT Pub. No.: WO2010/104296

PCT Pub. Date: Sep. 16, 2010

(65) Prior Publication Data

US 2011/0317526 A1 Dec. 29, 2011

(30) Foreign Application Priority Data

Mar. 11, 2009 (KR) ..... 20-2009-0002778 U

(51) Int. Cl.
*G04C 21/16* (2006.01)

(52) U.S. Cl.
USPC ..... 368/256

(58) Field of Classification Search
USPC ..... 368/10, 72–75, 79, 245, 250–252, 368/256, 11, 12; 362/153, 253, 84, 86, 103, 362/226, 228, 234, 251
See application file for complete search history.

(56) References Cited

U.S. PATENT DOCUMENTS

| | | | | |
|---|---|---|---|---|
| 5,926,440 | A * | 7/1999 | Chien | 368/10 |
| 6,236,622 | B1 * | 5/2001 | Blackman | 368/10 |
| 6,987,710 | B2 * | 1/2006 | Kibiloski et al. | 368/67 |
| 2010/0278016 | A1 * | 11/2010 | Sandu et al. | 368/10 |

FOREIGN PATENT DOCUMENTS

| | | |
|---|---|---|
| JP | 08-068876 | 3/1996 |
| KR | 1997-010772 | 3/1997 |
| KR | 1019990044756 | 6/1999 |
| KR | 20-0434138 | 12/2006 |

* cited by examiner

*Primary Examiner* — Edwin A. Leon
(74) *Attorney, Agent, or Firm* — IPLA P.A.; James E. Bame

(57) ABSTRACT

An alarm clock includes a power supply unit; a key input setting unit (110); the lamp (140); a microcomputer (120) configured to be provided with a timer having a clock function; the time display unit (170); the alarm module (160) configured to be selectively turned on and off in response to the alarm control signal output by the microcomputer (120); a lamp power supply control unit (130) configured to be selectively switched on and off in response to the lamp drive control signal output by the microcomputer (120); and a lamp current adjustment unit (160) configured to perform control so that an amount of current flowing through the lamp (140) gradually increases based on the pulse width signal output by the microcomputer (120). The lamp gradually fades in and an alarm is issued after the lamp has been completely lit up.

5 Claims, 1 Drawing Sheet

ALARM CLOCK WHICH OPERATES IN CONJUNCTION WITH A GRADUALLY FADING-IN LAMP

BACKGROUND OF THE INVENTION

The present invention relates, in general, to an alarm clock and, more particularly, to an alarm clock which operates in conjunction with a gradually fading-in lamp, in which the lamp gradually fades in from the set time and is then turned on completely and also an alarm is issued after the lamp has been completely lit up, so that surprise or irritation attributable to an abrupt alarm can be prevented, and in which the lamp is controlled so that it can gradually fade in, so that dazzling attributable to the abrupt turning on of the lamp can be prevented, thereby making it suitable for smoothly and naturally waking up upon waking up.

In general, an alarm clock is a clock that helps to wake up a user by issuing an alarm sound signal, such as a sound or a melody, at a specific set time, such as the time at which the sun rises.

Recently, an alarm clock combined with a lamp in which the lamp is attached to the alarm clock has appeared. Such a conventional alarm clock combined with a lamp performs the operation of issuing an alarm and lighting up the lamp at the same time.

However, since the conventional alarm clock combined with a lamp is configured to light up the lamp and issue an alarm immediately at the set time, a sleeping person may be startled by the abrupt alarm or may be irritated while he or she is half asleep and half awake, and a sleeping person cannot open his or her eyes due to being dazzled because the lamp is immediately lit up, thereby making rising rather uncomfortable.

SUMMARY OF THE INVENTION

Accordingly, the present invention has been made keeping in mind the above problems occurring in the prior art, and an object of the present invention is to provide an alarm clock which operates in conjunction with a gradually fading-in lamp, in which the lamp gradually fades in from the set time, such as the time at which the sun rises, and is then turned on completely and also an alarm is issued after the lamp has been completely lit up, so that surprise or irritation attributable to an abrupt alarm can be prevented, and in which the lamp is controlled so that it can gradually fade in, so that dazzling attributable to the abrupt turning on of the lamp can be prevented, thereby making it suitable for smoothly and naturally waking up upon waking up.

In order to accomplish the above object, the present invention provides an alarm clock which operates in conjunction with a gradually fading-in lamp, including a power supply unit; a key input setting unit including a lamp activation time setting unit for setting the activation time of a lamp and an alarm activation time setting unit for setting the activation time of an alarm module; the lamp for emitting light using power supplied by a power supply unit; a microcomputer configured to be provided with a timer having a clock function, which is stored in the form of a program, to output a lamp drive control signal and a pulse width signal at the lamp activation time set by the lamp activation time setting unit, to output an alarm control signal at the activation time of the alarm module set by the alarm activation time setting unit, and to output a time display signal to the time display unit; the time display unit for receiving the time display signal output by the microcomputer, and then displaying current time; the alarm module configured to be selectively turned on and off in response to the alarm control signal output by the microcomputer, and to output a sound alarm signal; a lamp power supply control unit connected between the power supply unit and the lamp, and configured to be selectively switched on and off in response to the lamp drive control signal output by the microcomputer and to control the power supplied by the power supply unit to the lamp; and a lamp current adjustment unit connected in series to the lamp, and configured to perform control so that the amount of current flowing through the lamp gradually increases based on the pulse width signal output by the microcomputer, thereby making the lamp gradually fade in.

The an alarm clock which operates in conjunction with a gradually fading-in lamp according to the present invention, which is configured as described above, are advantageous in that the lamp gradually fades in from the set time, such as the time at which the sun rises, and is then turned on completely and also an alarm is issued after the lamp has been completely lit up, so that surprise or irritation attributable to an abrupt alarm can be prevented, and in that the lamp is controlled so that it can gradually fade in, so that dazzling attributable to the abrupt turning on of the lamp can be prevented, thereby making it suitable for smoothly and naturally waking up upon waking up.

DETAILED DESCRIPTION OF THE INVENTION

A preferred embodiment of an alarm clock which operates in conjunction with a gradually fading-in lamp according to the present invention will be described in detail below based on the accompanying drawings.

Figure 1:
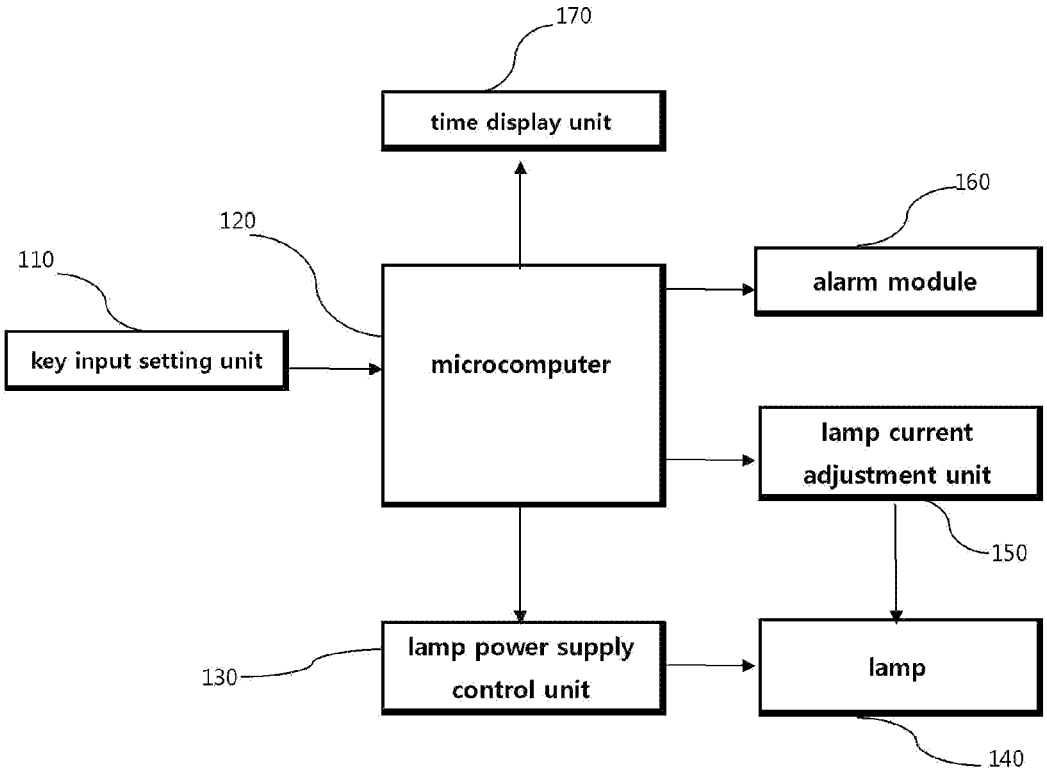
FIG. 1 is a block diagram of an alarm clock which operates in conjunction with a gradually fading-in lamp according to an embodiment of the present invention.
Figure 2:
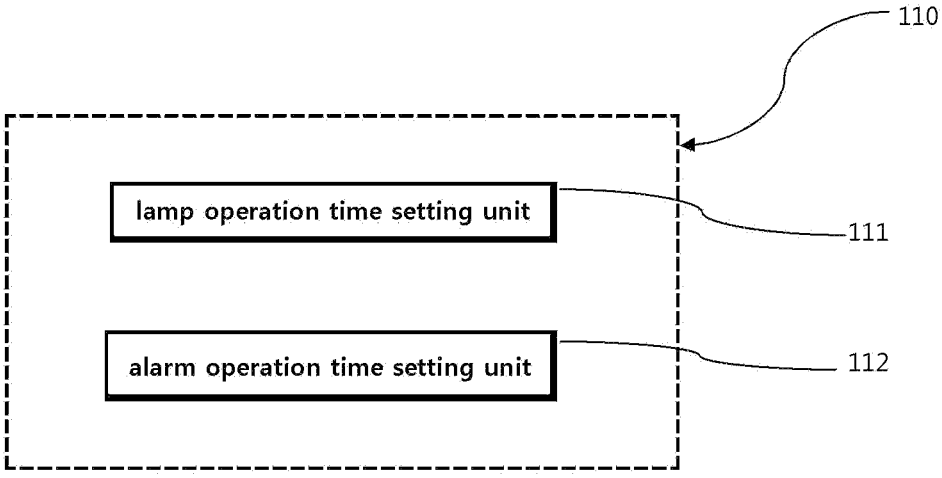
FIG. 2 is a diagram illustrating the detailed configuration of the key input setting unit in FIG. 1.

FIG. 1 shows a block diagram of the alarm clock which operates in conjunction with a gradually fading-in lamp according to the embodiment of the present invention, and FIG. 2 shows a diagram illustrating the detailed configuration of the key input setting unit 110 in FIG. 1.

As shown in FIGS. 1 and 2, the alarm clock which operates in conjunction with a gradually fading-in lamp according to the embodiment of the present invention is configured to include a power supply unit (not shown), a key input setting unit 110, a lamp 140, a microcomputer 120, a time display unit 170, an alarm module 160, a lamp power supply control unit 130, and a lamp current adjustment unit 150.

The power supply unit is a power supply device which receives commercial AC power, rectifies it and supplies predetermined DC power to components, such as the microcomputer 120, the lamp 140, the lamp current adjustment unit 150, and the alarm module 160, and may be charged with power. A battery may be used as the power supply unit.

The key input setting unit 110 includes a lamp activation time setting unit 111 for setting the activation time of the lamp 140 and an alarm activation time setting unit 112 for setting the activation time of the alarm module 160.

The lamp 140 is a light emitting device that emits light using power supplied by the power supply unit.

The microcomputer 120 is provided with a timer, having a clock function, which is stored in the form of a program, outputs a lamp drive control signal and a pulse width signal at the lamp activation time set by the lamp activation time setting unit 111 of the key input setting unit 110, outputs an alarm control signal at the activation time of the alarm module 160 set by the alarm activation time setting unit 112, outputs a time display signal to the time display unit 170, and controls the overall configuration.

The time display unit 170 receives the time display signal output by the microcomputer 120, and then displays the current time.

The alarm module 160 is selectively turned on and off in response to the alarm control signal output by the microcomputer 120, and then outputs a sound alarm signal, such as a melody and a bell sound.

The lamp power supply control unit 130 is connected between the power supply unit and the lamp 140, and is selectively switched on and off in response to the lamp drive control signal output by the microcomputer 120 and controls the supply of power from the power supply unit to the lamp 140.

The lamp current adjustment unit 150 is connected in series to the lamp 140, and performs control so that the amount of current flowing through the lamp 140 gradually increases based on the pulse width signal output by the microcomputer 120, thereby making the lamp 140 gradually fade in.

In the alarm clock which operates in conjunction with a gradually fading-in lamp according to the embodiment of the present invention, the pulse width signal, which is output to the lamp current adjustment unit 150 by the microcomputer 120 so that the lamp current adjustment unit 150 controls current flowing through the lamp 140 so that the amount of current gradually increases, is characterized in that the width of a logic high pulse that turns on the lamp 140 gradually increases over time.

Furthermore, in the alarm clock which operates in conjunction with a gradually fading-in lamp according to the embodiment of the present invention, the lamp 140 is a Light Emitting Diode (LED).

In the alarm clock which operates in conjunction with a gradually fading-in lamp according to the embodiment of the present invention, the lamp power supply control unit 130 is formed of, for example, a triac (now shown).

In the alarm clock which operates in conjunction with a gradually fading-in lamp according to the embodiment of the present invention, the lamp current adjustment unit 150 includes a buffer amplifier unit (not shown) for performing a buffer amplifier function on the pulse width signal output by the microcomputer 120, and a Field Effect Transistor (FET) (not shown) for controlling the amount of current flowing through the lamp 140 in response to the pulse width signal on which the buffer amplifier function has been performed by the buffer amplifier unit (not shown).

The operation of the alarm clock which operates in conjunction with a gradually fading-in lamp according to the present invention, which is configured as described above, will be described below.

First, the lamp activation time is set to, for example, 07:00:00 by the lamp activation time setting unit 112, and the activation time of the alarm module 160 is set to, for example, to 07:01:00 by the alarm activation time setting unit 112.

The microcomputer 120 always executes the timer program stored in internal memory. Accordingly, when 07:00:00 is reached, the microcomputer 120 outputs a lamp drive control signal to the lamp power supply control unit 130, thereby controlling the lamp power supply control unit 130 so that it is switched on and therefore current is supplied to the lamp 140, and at the same time outputs a pulse width signal, the pulse width of which gradually increases over time, to the lamp current adjustment unit 150, thereby performing control so that the amount of current flowing through the lamp 140 gradually increases.

By the above-described operation, the lamp 140 is made to gradually fade in over time. When the time at which the lamp 140 has completely faded in, that is, the activation time of the alarm module 160 (in the above example, 07:01:00), is reached, the microcomputer 120 activates the alarm module 160 to operate by outputting an alarm control signal to the alarm module 160. A sleeping person who gradually wakes up without being dazzled because the lamp 140 gradually fades in is made to completely wake up by the alarm sound issued by the alarm module 160, and accordingly the sleeping person can smoothly and naturally wake up.

The above-described embodiment of the present invention is merely an embodiment of the technical spirit of the present invention, and it will be apparent to those having ordinary skill in the art that other modified practices are possible within the scope of the technical spirit of the present invention.

The invention claimed is:

1. An alarm clock which operates in conjunction with a gradually fading-in lamp, comprising:

a power supply unit;

a key input setting unit (110) comprising a lamp activation time setting unit (111) for setting an activation time of a lamp (140) and an alarm activation time setting unit (112) for setting an activation time of an alarm module (160);

the lamp (140) for emitting light using power supplied by a power supply unit;

a microcomputer (120) configured to be provided with a timer having a clock function, which is stored in a form of a program, to output a lamp drive control signal and a pulse width signal at the lamp activation time set by the lamp activation time setting unit (111), to output an alarm control signal at the activation time of the alarm module (160) set by the alarm activation time setting unit (112), and to output a time display signal to the time display unit (170);

the time display unit (170) for receiving the time display signal output by the microcomputer (120), and then displaying current time;

the alarm module (160) configured to be selectively turned on and off in response to the alarm control signal output by the microcomputer (120), and to output a sound alarm signal;

a lamp power supply control unit (130) connected between the power supply unit and the lamp (140), and configured to be selectively switched on and off in response to the lamp drive control signal output by the microcomputer (120) and to control the power supplied by the power supply unit to the lamp (140); and a lamp current adjustment unit (150) connected in series to the lamp (140), and configured to perform control so that an amount of current flowing through the lamp (140) gradually increases based on the pulse width signal output by the microcomputer (120), thereby making the lamp (140) gradually fade in, wherein the pulse width signal, which is output to the lamp current adjustment unit (150) by the microcomputer (120) so that the lamp current adjustment unit (160) can perform control so that the amount of current flowing through the lamp (140) gradually increases, is characterized in that a width of a logic high pulse that turns on the lamp (140) gradually increases over time.

2. The alarm clock as set forth in claim 1, wherein the lamp (140) is a Light Emitting Diode (LED).

3. The alarm clock as set forth in claim 2, wherein the lamp current adjustment unit (160) comprises a buffer amplifier unit for performing a buffer amplifier function on the pulse width signal output by the microcomputer (120), and a Field Effect Transistor (FET) for controlling the amount of current flowing through the lamp (140) in response to the pulse width signal on which the buffer amplifier function has been performed by the buffer amplifier unit.

4. The alarm clock as set forth in claim 3, wherein the lamp power supply control unit (130) comprises a triac.

5. The alarm clock as set forth in claim 1, wherein the lamp (140) is a Light Emitting Diode (LED).

* * * * *